United States Patent [19]

Waslo et al.

[11] Patent Number: 4,982,570

[45] Date of Patent: Jan. 8, 1991

[54] PREMIXED PILOT NOZZLE FOR DRY LOW NOX COMBUSTOR

[75] Inventors: Jennifer Waslo, Scotia; Masayoshi Kuwata, Ballston Lake; Roy M. Washam, Schenectady, all of N.Y.

[73] Assignee: General Electric Company, Schenectady, N.Y.

[21] Appl. No.: 501,439

[22] Filed: Mar. 22, 1990

Related U.S. Application Data

[63] Continuation of Ser. No. 934,885, Nov. 25, 1986, abandoned.

[51] Int. Cl.[5] ..... F23R 3/34

[52] U.S. Cl. ..... 60/733; 60/737

[58] Field of Search ..... 60/732, 737, 738, 748, 60/733

[56] References Cited

U.S. PATENT DOCUMENTS

| | | | |
|---|---|---|---|
| 3,648,457 | 3/1972 | Bobo . | |
| 3,703,259 | 11/1972 | Sturgess et al. | 60/742 |
| 3,713,588 | 1/1973 | Sharpe | 60/742 |
| 3,886,728 | 6/1975 | Quinn . | |
| 3,958,416 | 5/1976 | Hammond, Jr. . | |
| 4,023,351 | 5/1977 | Beyler et al. | 60/742 |
| 4,125,998 | 11/1978 | Barou et al. | 60/737 |
| 4,292,801 | 10/1981 | Wilkes et al. | 60/39.06 |
| 4,389,848 | 6/1983 | Markowski et al. | 60/738 |
| 4,589,260 | 5/1986 | Krockow | 60/748 |

FOREIGN PATENT DOCUMENTS

| | | |
|---|---|---|
| 0095788 | 4/1983 | European Pat. Off. . |
| 2613589 | 10/1976 | Fed. Rep. of Germany . |
| 1521195 | 8/1978 | United Kingdom . |

*Primary Examiner*—Louis J. Casaregola
*Assistant Examiner*—T. S. Thorpe
*Attorney, Agent, or Firm*—Nixon & Vanderhye

[57] ABSTRACT

A dual mode, dual stage low NOx combustor, includes a primary combustion chamber and a secondary combustion chamber separated by a throat region of reduced diameter. Fuel is input into the primary combustors by an annular array of diffusion type nozzles whereas in accordance with the invention fuel is input into the secondary combustor by a central combination premix and diffusion nozzle.

16 Claims, 2 Drawing Sheets

PREMIXED PILOT NOZZLE FOR DRY LOW NOX COMBUSTOR

This is a continuation of application Ser. No. 06/934,885, filed Nov. 25, 1986, now abandoned.

BACKGROUND OF THE INVENTION

This invention relates to gas turbine combustors; and, in particular, to improvements in gas turbine combustors for the further diminishment of air pollutants such as nitrogen oxides (NOx).

In an effort to reduce the amount of NOx in the exhaust gas of a gas turbine, inventors Wilkes and Hilt devised the dual stage, dual mode combustor which is shown in U.S. Pat. No. 4,292,801 issued Oct. 6, 1981 to a common assignee of the present invention. In this aforementioned patent, which is incorporated herein by reference, it was discovered that the amount of exhaust NOx could be greatly reduced, as compared with a conventional single stage, single fuel nozzle combustor, if there were two combustion chambers established such that under conditions of normal operating load, the upstream primary combustion chamber performed as a premix chamber whereas actual combustion occurred in the downstream second combustion chamber. Under this described operating condition, there would be no flame in the primary chamber resulting in a decrease in the formation of NOx. In this condition of operation, the secondary or center nozzle provides the flame source for the operation of the combustor. The specific configuration of the patented invention includes an annular array of primary nozzles each of which discharges into the primary combustion chamber and a central secondary nozzle which discharges into the second combustion chamber. These nozzles may all be described as diffusion nozzles in that each nozzle has an axial fuel delivery pipe and is surrounded at its discharge end by an air swirler which provides air for combustion to the fuel nozzle discharge. The present inventors have discovered that further reduction in the production of NOx can be achieved by altering the design of the central or secondary nozzle such that it may be described as a combined premix and diffusion nozzle. In operation, a relatively small amount of fuel is used to sustain a diffusion pilot whereas a premix section of the nozzle provides additional fuel for ignition of the main fuel supply from the upstream primary nozzles directed into the primary combustion chamber.

OBJECTS OF THE INVENTION

It is an object of the present invention to provide a stable and sufficient heat source to ignite a primary premixed flow over a range of operating conditions.

It is another object of this invention to minimize the contribution of the flame source to NOx emissions.

It is another object of this invention to minimize the amount of fuel which is used to provide a pilot diffusion flame.

The novel features believed characteristic of the present invention are set forth in the appended claims. The invention itself, however, together with further objects and advantages thereof may best be understood with reference to the following description and drawings.

SUMMARY OF THE INVENTION

The present invention is especially applicable to gas turbine combustors of the type which include two combustion chambers separated by a venturi throat region. An annular array of primary nozzles discharge fuel into an upstream or primary combustion chamber whereas a single central nozzle discharges fuel into a downstream or second combustion chamber. The method of operation dictates that while under base load, the primary nozzles are flamed out whereas the single central or second nozzle supports combustion of premix fuel from the primary nozzles. According to the invention, the single central second nozzle, which has been characterized as a diffusion nozzle, is replaced by a combined diffusion and premix nozzle which reduces the fuel flow to the central diffusion flame from approximately 20 percent of the total fuel flow to about 2 percent of the total fuel flow for the entire combustor. This is done by installing an air delivery pipe around a minimal fuel delivery pipe to support the diffusion flame combustion whereas the maximum fuel delivery within the secondary nozzle occurs by way of radial fuel distribution tubes each of which discharge fuel into a premix chamber which surrounds the diffusion pilot comprising the axial fuel delivery pipe and its surrounding air delivery pipe. In this manner, a relatively minute amount of fuel, in a diffusion flame, may be used to ignite the central nozzle premix chamber flow but the amount required is considerably less than would be needed to ignite the main premix flow from the remaining surrounding primary nozzles. The design thus simultaneously minimizes the percentage of total fuel flow in the combustor that burns as a diffusion flame (with high NOx emissions) but allows sufficient heat input to ignite the main premixed flow by using the pilot premixed flow (which has low NOx emissions).

DETAILED DESCRIPTION OF THE INVENTION

Figure 1:
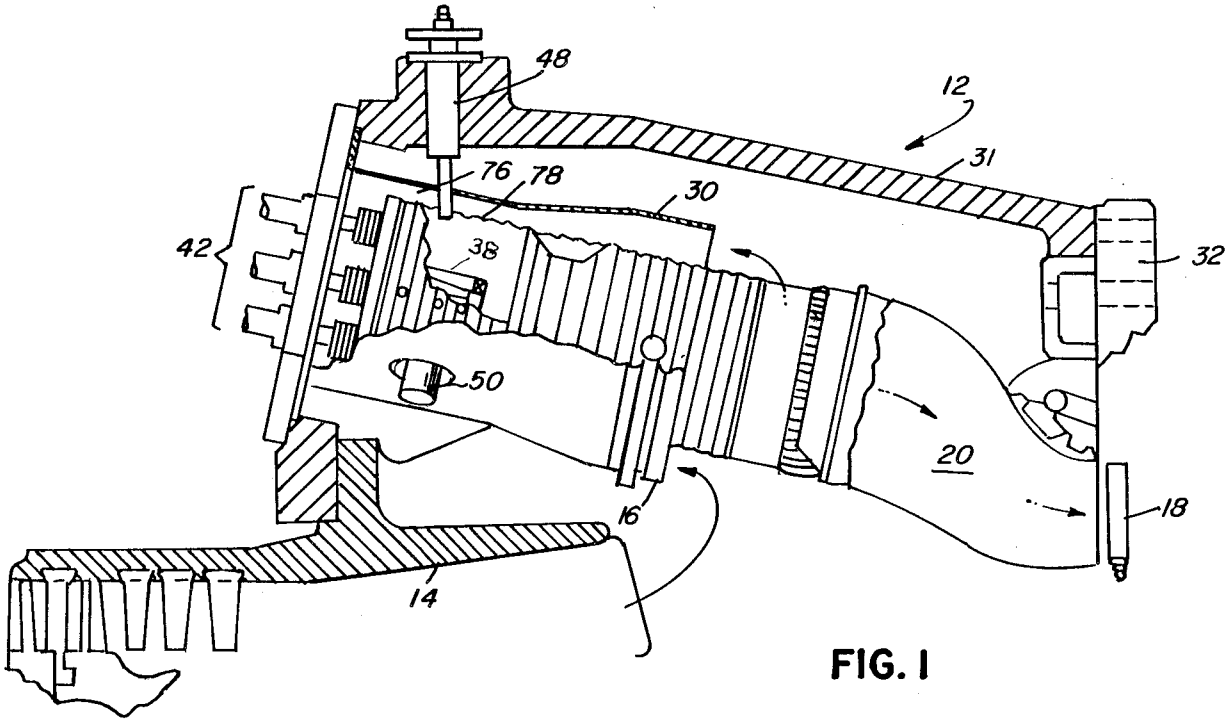
FIG. 1 is an elevation view of a gas turbine engine shown in partial cross section.

Referring to FIG. 1, a gas turbine 12 includes a compressor 14, a combustor 16 and a turbine 18 represented by a single blade. Although it is not specifically shown, it is well known that the turbine is drivingly connected to the compressor along a common axis. The compressor pressurizes inlet air which is then turned in direction or reversed flowed to the combustor where it is used to cool the combustor and also used to provide air to the combustion process. The gas turbine includes a plurality of combustors (one shown) which are located about the periphery of the gas turbine. In one particular gas turbine model there are fourteen such combustors disposed about the periphery of the gas turbine. A transition duct 20 connects the outlet end of its particular combustor with the inlet end of the turbine to deliver the hot products of the combustion process to the turbine.

Figure 2:
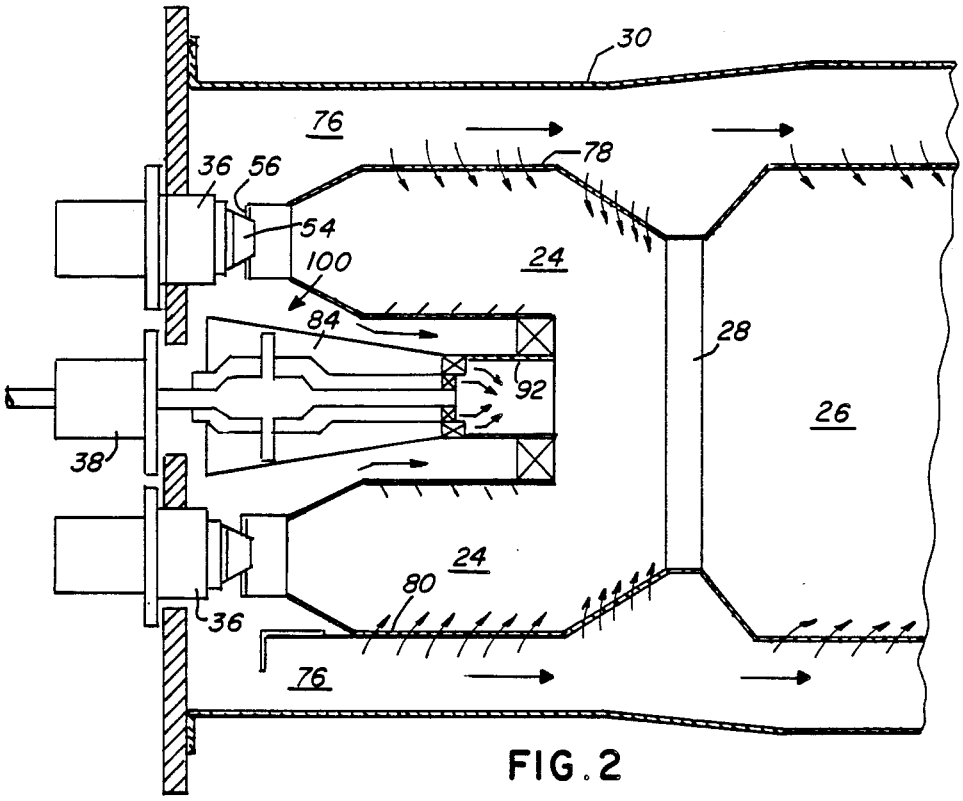
FIG. 2 is an enlarged detailed elevation view of a combustor section of the gas turbine engine.

The invention to be described is particularly useful in a dual stage, dual mode low NOx combustor of the type described in U.S. Pat. No. 4,292,801. As described in that patent; and, as shown in FIG. 2 herein, each combustor comprises a primary or upstream combustion chamber 24 and a second or downstream combustion chamber 26 separated by a venturi throat region 28. The combustor is surrounded by a combustor flow sleeve 30 which channels compressor discharge air flow to the combustor. The combustor is further surrounded by an outer casing 31 which is bolted to the turbine casing 32.

Primary nozzles 36 provide fuel delivery to the upstream combustor 24 and are arranged in an annular array around a central secondary nozzle 38. In one model gas turbine, each combustor may include six primary nozzles and one secondary nozzle. To complete the description of the combustor, fuel is delivered to the nozzles through plumbing 42 in a manner well known in the art and fully described in the aforementioned patent. Ignition in the primary combustor is caused by spark plug 48 not shown in FIG. 2 and in adjacent combustors by means of crossfire tubes 50 also well known in the art.

In U.S. Pat. No. 4,292,801, it is pointed out that the fuel nozzles, both primary and secondary, are identical to one another; that is to say, the nozzles are all of the diffusion type. Referring to the present FIG. 2, a diffusion nozzle 36 includes a fuel delivery nozzle 54 and an annular swirler 56. The nozzle 54 delivers only fuel which is then subsequently mixed with swirler air for combustion. According to the patented teaching, the secondary nozzle is also a diffusion nozzle as will be explained further.

During base-load operation, the dual stage, dual mode combustor is designed to operate in a premix mode such that all of the primary nozzles are simply mixing fuel and air to be ignited by the diffusion flame supported by the second or central diffusion nozzle. This premixing of the primary nozzle fuel and ignition by the secondary diffusion nozzle led to a lower NOx output in the combustor. However, there was at least one basic drawback to the system as described. For example, laboratory testing revealed that while utilizing the minimum possible percentage of fuel in the secondary nozzle minimized the NOx emissions at some operating conditions, the same low percentage of fuel in the secondary nozzle did not provide sufficient heat input to satisfactorily burn the main premixed flow at other operating conditions. The applicants have discovered that a satisfactory pilot flame for the main premix flow from the upstream premix (primary) nozzles may be sustained by using a minimal diffusion pilot in combination with a central nozzle premix chamber. Thus the invention simultaneously minimizes the percentage of total fuel in the combustor that burns as a diffusion flame (with high NOx emissions) while allowing sufficient heat input to ignite the main premixed flow by using the premixed secondary or pilot flow.

Figure 3:
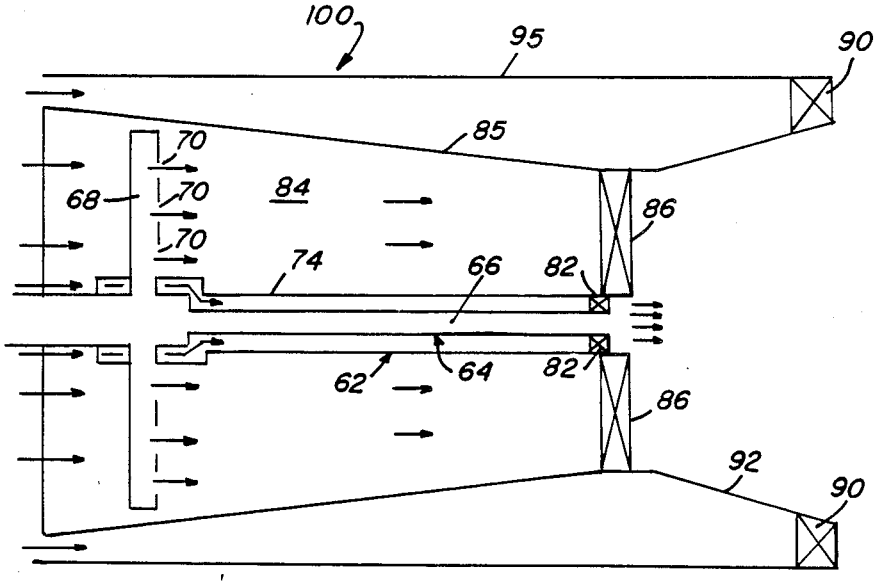
FIG. 3 is a schematic view of the combination diffusion and premix nozzle in accordance with the present invention.

Therefore in accordance with the present invention and referring to FIGS. 2 and 3, a combined diffusion and premix nozzle 100 is disclosed. The combined nozzle includes a diffusion pilot 62 having a fuel delivery pipe 64. The fuel delivery pipe has an axial pipe 66 and a plurality of radial, blind ended fuel distribution tubes 68 which extend radially outwardly from the axial pipe. In the preferred embodiment there may be six such fuel distribution tubes. As is most apparent from FIG. 3, the fuel distribution tubes each include a plurality of fuel discharge holes 70 which are directed downstream toward the discharge end of the combined nozzle. The fuel distribution holes are sized so as to obtain the desired percentage of fuel flow into the premix chamber to be hereinafter described.

The diffusion pilot 62 further includes an air delivery pipe 74 coaxial with and surrounding the fuel delivery axial pipe 66. The air input into the air delivery pipe is compressor discharge air which is reverse flowed around the combustor into the volume 76 defined by the flow sleeve 30 and the combustion chamber liner 78. The diffusion pilot includes at its discharge end a first swirler annulus or diffusion pilot swirler 82 for the purpose of directing air delivery pipe discharge air to the diffusion pilot flame.

A premix chamber 84 is defined by a sleeve like truncated cone 85 which surrounds the diffusion pilot and includes a discharge end (see flow arrows) terminating adjacent the diffusion pilot discharge end. Compressor discharge air is also reverse flowed into the premix chamber from volume 76 in a manner similar to the air delivery pipe. The plurality of radial fuel distribution tubes 68 extend through the air delivery pipe 74 and into the premix chamber annulus such that the fuel and air are mixed and delivered to a second swirler or premix chamber swirler 86 between the diffusion pilot and the premix chamber truncated cone 85.

A third swirler or central nozzle swirler 90 is located downstream from the discharge end of the combination diffusion and premix nozzle. This swirler is located between an extension or cup 92 on the discharge end of the pilot and the centerbody wall 95 of the primary combustion chamber. Compressor air is also reverse flowed to this swirler from the volume 76 surrounding the combustion liners. The purpose of this third swirler is to provide stability for the diffusion and premix nozzle flame when combining with the primary premix flow from the primary combustor.

The required design of the swirlers 82, 86 and 90 would be known to practitioners in the combustion art and therefore requires no further description. The premix chamber or truncated cone is formed of any metal suitable to use within the gas turbine environment.

In operation, during the start-up phase, fuel flow and combustion is initiated in the primary combustor until a predetermined mid-range load. At that time, fuel flow is split between the primary nozzles and the secondary nozzle to reach a desired load whereas ignition of the secondary nozzle is established. Fuel flow to the primary nozzles is then terminated to extinguish burning in the primary combustor. Fuel flow then is reestablished in the primary nozzles which then act as main premix chambers for the primary nozzle fuel flow whereas the second or central nozzle remains ignited and thus becomes a pilot flame for the primary main premix flow. At this point, according to prior practice, a diffusion flame using approximately twenty percent of the total combustor fuel flow would be left to produce a relatively high NOx output.

According to the present invention with the combined diffusion and premix nozzle installed, only approximately two percent of the total combustor fuel flow is used to support the diffusion flame resulting in a substantial reduction of the output of NOx. The remainder of the pilot or second nozzle fuel is subject to premix in the premix chamber thus emitting a much lower level of NOx output. In summary, the foregoing invention as described produces less NOx while providing an opportunity to add to the fuel flow through the secondary nozzle because of the lower NOx output whereas the turn down ratio or the ability to operate under varying conditions is considerably widened because the diffusion pilot is subject to the premix flow of the pilot rather than the total overall premix flow from the surrounding primary nozzles.

While the invention has been described with respect to a specific embodiment, those skilled in the art can readily appreciate various changes and modifications thereto within the true spirit and scope of the appended claims. Accordingly, the claims are intended to cover such modifications and variations.

What we claim is:

1. A combined diffusion and premix nozzle comprising:

a diffusion pilot comprising a first axial fuel delivery pipe having an inlet end and a discharge end; a second axial air delivery pipe coaxial with the first axial fuel delivery pipe and surrounding the first axial fuel delivery pipe; and, a first swirler annulus disposed at the discharge end of the first axial fuel delivery pipe between the first axial fuel delivery pipe and the surround second axial air delivery pipe;

the first axial fuel delivery pipe further including a plurality of radial fuel distribution tubes extending outwardly from the first axial fuel delivery pipe and located toward the inlet end of the first axial fuel delivery pipe, the radial fuel distribution tubes extending beyond the circumference of the second axial air delivery pipe; said second axial air delivery pipe having an air inlet end upstream of said radial fuel distribution tubes;

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber; and, a second swirler annulus at the discharge end of the premix chamber between the second axial air delivery pipe and the surrounding premix chamber.

2. An improved gas turbine combustor of the type including first and second combustion chambers interconnected by a throat region, said throat region being of reduced dimension compared to the first and second combustion chambers; a plurality of diffusion type primary fuel nozzles in annular array upstream from the first combustion chamber for introducing fuel into the first combustion chamber, each of the diffusion nozzles including an annular swirler for introducing pressurized air into the first combustion chamber for creating a combustible fuel air mixture; wherein the improvement comprises:

a combined diffusion and premix nozzle positioned upstream from the second combustion chamber and having a discharge end directed into the second combustion chamber, wherein the combined diffusion and premix nozzle includes a diffusion pilot comprising an axial fuel delivery pipe and an air delivery pipe surrounding the axial fuel delivery pipe, along substantially the entire length of said axial fuel delivery pipe.

3. The improvement recited in claim 2 wherein the combined diffusion and premix nozzle includes:

a diffusion pilot swirler annulus between the fuel delivery pipe and the air delivery pipe;

a premix chamber surrounding the diffusion pilot; a plurality of fuel discharge tubes extending radially outwardly from the fuel delivery pipe through the air delivery pipe and into the premix chamber; at least one fuel discharge hole in at least one of the radial fuel distribution tubes directed toward the discharge end of the premix chamber whereby fuel is distributed into the premix chamber; and, a premix chamber swirler located adjacent the discharge end of the combined diffusion and premix chamber nozzle between the air delivery pipe and the premix chamber.

4. The improvement recited in claim 3 wherein the premix chamber is a truncated cone.

5. The improvement recited in claim 2 wherein the combined diffusion and premix nozzle is located in the center of the annular array of a plurality of primary nozzles and further includes a third swirler between the combined nozzle and a surrounding centerbody wall.

6. In a dual stage, dual mode low NOx combustor, a central fuel nozzle comprising:

a diffusion pilot comprising a an axial fuel delivery pipe having an inlet end and a discharge end; an air delivery pipe coaxial with the axial fuel delivery pipe and surrounding the axial fuel delivery pipe, said air delivery pipe having an inlet end and a discharge end; and, a first swirler annulus disposed at the discharge end of the axial pipe fuel delivery between the axial fuel delivery pipe and the surrounding air delivery pipe;

the fuel delivery pipe further including a plurality of radial fuel distribution tubes extending outwardly from the axial fuel delivery pipe and located toward the inlet end of the axial fuel delivery pipe, the radial fuel distribution tubes extending beyond the circumference of the air delivery pipe; said inlet end of the air delivery pipe located intermediate the inlet end of the axial fuel delivery pipe and the radial fuel distribution tubes;

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber;

a second swirler annulus at the discharge end of the premix chamber between the air delivery pipe and the surrounding premix chamber;

a cup positioned downstream from the discharge end of the central nozzle and a centerbody wall surrounding the central fuel nozzle; and, a third swirler annulus between the centerbody wall and the cup.

7. A combined diffusion and premix nozzle comprising:

a diffusion pilot comprising a first axial fuel delivery pipe having an inlet end and a discharge end; a second axial air delivery pipe coaxial with the first axial fuel delivery pipe and surrounding the first axial fuel delivery pipe; and, a first swirler annulus disposed at the discharge end of the first axial fuel delivery pipe between the first axial fuel delivery pipe and the surrounding second axial air delivery pipe;

the first axial fuel delivery pipe further including a plurality of radial fuel distribution tubes extending outwardly from the first axial fuel delivery pipe and located toward the inlet end of the first axial fuel delivery pipe, the radial fuel distribution tubes extending beyond the circumference of the second axial air delivery pipe; said second axial air delivery pipe having an air inlet end upstream of said radial fuel distribution tubes.

8. A combined diffusion and premix nozzle according to claim 7 and further including:

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber; and, a second swirler annulus at the discharge end of the premix chamber between the second axial air delivery pipe and the surrounding premix chamber.

9. A combined diffusion and premix nozzle according to claim 7, wherein said inlet of said second air delivery pipe lies intermediate said inlet of the fuel delivery pipe and said plurality of radial fuel distribution tubes.

10. A combined diffusion and premix nozzle, according to claim 7 and further including a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber;

a second swirler annulus at the discharge end of the premix chamber between the air delivery pipe and the surrounding premix chamber;

a cup positioned downstream from the discharge end of the central nozzle and a centerbody wall surrounding the central fuel nozzle; and, a third swirler annulus between the centerbody wall and the cup.

11. A combined diffusion and premix nozzle comprising:

a diffusion pilot comprising a fuel delivery pipe including an axial pipe having an inlet end and a discharge end; an air delivery pipe coaxial with the axial pipe and surrounding the axial pipe; and, a first swirler annulus disposed at the discharge end of the axial pipe between the axial pipe and the surrounding air delivery pipe;

the fuel delivery pipe further including a plurality of radial fuel distribution tubes extending outwardly from the axial pipe and located toward the inlet end of the axial pipe, the radial fuel distribution tubes extending beyond the circumference of the air delivery pipe;

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber; and, a second swirler annulus at the discharge end of the premix chamber between the air delivery pipe and the surrounding premix chamber.

12. An improved gas turbine combustor of the type including first and second combustion chambers interconnected by a throat region, said throat region being of reduced dimension compared to the first and second combustion chambers; a plurality of diffusion type primary fuel nozzles in annular array upstream from the first combustion chamber for introducing fuel into the first combustion chamber, each of the diffusion nozzles including an annular swirler for introducing pressurized air into the first combustion chamber for creating a combustible fuel air mixture; wherein the improvement comprises:

a combined diffusion and premix nozzle positioned upstream from the second combustion chamber and having a discharge end directed into the second combustion chamber.

13. The improvement recited in claim 2 wherein the combined diffusion and premix nozzle includes:

a diffusion pilot comprising an axial fuel delivery pipe and an air delivery pipe surrounding the axial fuel delivery pipe; a diffusion pilot swirler annulus between the fuel delivery pipe and the air delivery pipe;

a premix chamber surrounding the diffusion pilot; a plurality of fuel discharge tubes extending radially outwardly from the fuel delivery pipe through the air delivery pipe and into the premix chamber; at least one fuel discharge hole in at least one of the radial fuel distribution tubes directed toward the discharge end of the premix chamber; and, a premix chamber swirler located adjacent the discharge end of the combined diffusion and premix chamber nozzle between the air delivery pipe and the premix chamber.

14. The improvement recited in claim 3 wherein the premix chamber is a truncated cone.

15. The improvement recited in claim 2 wherein the combined diffusion and premix nozzle is located in the center of the annular array of a plurality of primary nozzles and further includes a third swirler between the combined nozzle and a surrounding centerbody wall.

16. In a dual stage, dual mode low NOx combustor, a central fuel nozzle comprising:

a diffusion pilot comprising a fuel delivery pipe including an axial pipe having an inlet end and a discharge end; an air delivery pipe coaxial with the axial pipe and surrounding the axial pipe; and, a first swirler annulus disposed at the discharge end of the axial pipe between the axial pipe and the surrounding air delivery pipe;

the fuel delivery pipe further including a plurality of radial fuel distribution tubes extending outwardly from the axial pipe and located toward the inlet end of the axial pipe, the radial fuel distribution tubes extending beyond the circumference of the air delivery pipe;

a premix chamber surrounding the diffusion pilot and including an inlet end and a discharge end, the radial fuel distribution tubes extending into the premix chamber;

at least one fuel discharge hole in at least one radial fuel distribution tube, the fuel discharge hole directed toward the discharge end of the premix chamber;

a cup positioned downstream front the discharge end of the central nozzle and a centerbody wall surrounding the central fuel nozzle; and, a third swirler annulus between the centerbody wall and the cup.

* * * * *